US008616337B1

(12) United States Patent
Rose, III

(10) Patent No.: US 8,616,337 B1
(45) Date of Patent: Dec. 31, 2013

(54) AUTOMOTIVE LIFT SYSTEM

(76) Inventor: Forest A. Rose, III, Phoenix, AZ (US)

( * ) Notice: Subject to any disclaimer, the term of this patent is extended or adjusted under 35 U.S.C. 154(b) by 229 days.

(21) Appl. No.: 13/105,804

(22) Filed: May 11, 2011

Related U.S. Application Data

(60) Provisional application No. 61/333,682, filed on May 11, 2010.

(51) Int. Cl.
*B66F 7/00* (2006.01)

(52) U.S. Cl.
USPC ..... 187/219

(58) Field of Classification Search
CPC ..... B66F 7/00; B66F 7/10; B66F 7/0641; B66F 7/0633; E04H 6/00
USPC ..... 187/203, 204, 207, 210, 213, 219, 220
See application file for complete search history.

(56) References Cited

U.S. PATENT DOCUMENTS

| | | | | |
|---|---|---|---|---|
| 1,476,596 | A * | 12/1923 | Cullen James V | 187/213 |
| 1,477,471 | A * | 12/1923 | Wellman | 187/213 |
| 6,845,848 | B1 * | 1/2005 | Kritzer | 187/221 |
| 2011/0094830 | A1 * | 4/2011 | Lund | 187/203 |

* cited by examiner

*Primary Examiner* — William E Dondero
*Assistant Examiner* — Diem Tran
(74) *Attorney, Agent, or Firm* — Blakely Sokoloff Taylor & Zafman LLP

(57) ABSTRACT

A four post automotive lift system is disclosed wherein each post contains a locking mechanism and adjustable lifting points. Each pair of posts has a transverse beam that is secured by the locking mechanisms and supports the weight of the vehicle. Each of the four posts are positioned on the floor and supported by a structure on the outside side of the lifting device. Each pair of posts on ether side of the vehicle is tied together by a supporting structure. The beam supporting the vehicle is lifted at each of the four posts by a simple lifting device and then locked in place on the post by the locking mechanism. The adjustable lifting point can be placed anywhere along the four posts to extend the range of the simple lifting device as the vehicle is lifted to different heights.

15 Claims, 12 Drawing Sheets

AUTOMOTIVE LIFT SYSTEM

CROSS REFERENCE TO RELATED APPLICATIONS

This application claims the benefit pursuant to 35 U.S.C. 119(e) of U.S. Provisional Application No. 61/333,682, filed May 11, 2010, which application is specifically incorporated herein, in its entirety, by reference.

BACKGROUND

1. Field

Embodiments of the invention relate to the field of automotive lift systems; and more specifically, to four post automotive lift systems.

2. Background

Automotive lift systems have been long known in prior art. However the primary systems used to perform maintenance and service on and from underneath of automotive vehicles have been large permanent in-ground post lift systems or semi-permanent above-ground 2 or 4 post systems that are mounted to the floor.

The typical above ground 2 post system has 2 vertical posts anchored to the floor at a distance wider then the vehicle to be lifted. Attached to each of these posts are two lifting arms that pivot horizontally and can be extended. The vehicle is driven between the 2 vertical posts and then the arms are extended under the vehicle. The arms are then pivoted apart to create 4 lifting points 90 degrees from each other. A synchronized hydraulic or electric lifting mechanism is attached to each of the 2 vertical posts and raises the lifting arms simultaneously thus lifting the vehicle.

The typical above ground 4 post systems has 4 vertical posts anchored to the floor 90 degrees from each other covering an area larger then the vehicle to be lifted. Attached to each of the vertical posts is a transverse mounted beam securing it to the post across from itself. Attached to these transverse mounted beams are a pair of parallel mounted longitudinal lifting platforms that form a rectangle between the 4 vertical posts with the transverse beams. The vehicle is driven on these lifting platforms two wheels on either side and a synchronized hydraulic or electric lifting mechanism attached to each of the 4 vertical posts lifts each corner of the transverse mounted beams simultaneously thus lifting the platform evenly and thereby lifting the vehicle.

SUMMARY

A four post automotive lift system is disclosed wherein each post contains a locking mechanism and adjustable lifting points. Each pair of posts has a transverse beam that is secured by the locking mechanisms and supports the weight of the vehicle. Each of the four posts are positioned on the floor and supported by a structure on the outside side of the lifting device. Each pair of posts on ether side of the vehicle is tied together by a supporting structure. The beam supporting the vehicle is lifted at each of the four posts by a simple lifting device and then locked in place on the post by the locking mechanism. The adjustable lifting point can be placed anywhere along the four posts to extend the range of the simple lifting device as the vehicle is lifted to different heights.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

Figure 1:
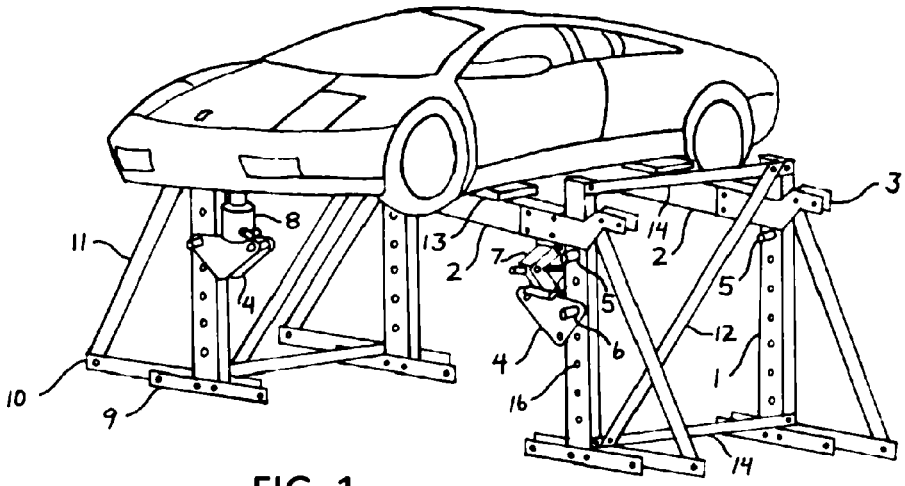
FIG. 1 is an isometric view of the automotive lifting system in the full upright position with vehicle thereupon.

In the following description, numerous specific details are set forth. However, it is understood that embodiments of the invention may be practiced without these specific details. In other instances, well-known circuits, structures and techniques have not been shown in detail in order not to obscure the understanding of this description.

It is an objective of the present invention to provide an automotive lifting system that does not require a synchronized lifting mechanism.

It is another goal to provide a system that is not anchored to the floor and can be quickly and easily dissembled and stored in a small space.

The above and other advantages and objectives of the present invention will become apparent from the Brief Description of the Drawings, the Detailed Description of the Drawings and the Claims appended here within.

The appeal of the lifting system descried is mostly in its simplicity and space saving design. This style of lift is unique in the market because it can use various simple lifting mechanisms; the operator can use one of many simple lifting devices such as a scissor jack, a hydraulic bottle jack, and/or a lead screw type jack, either manually or power operated, thus eliminating the need for expensive and complex lifting devices such as synchronized hydraulic and electric systems. Another appeal of this device and what also makes it unique to the market is that it can be quickly and easily be erected on site and then disassembled and stored in a small location. The lifting system when erected is self supporting and does not need to be anchored to the floor or to be set into the ground. When disassembled the entire unit can be stored in a small space allowing it to be used by the smaller shop or home mechanic where space is a concern.

An on-ground automotive lift system according to the present invention may include four vertical posts supported by triangulated supports, two on each side of the structure. The two vertical supports on each side of the structure longitudinally are separated by an adjustable structure that is also cross braced diagonally. Between the vertical posts mounted transversely are two main beams on which the vehicle is supported. The vertical posts have locating holes through them in order to place the truss brackets and locking pins for the main beams. The truss brackets can accommodate several simple lifting devices such as a scissor jack, hydraulic jack, or bumper jack to raise and lower the main beam. When the main beam is lifted by a jack supported by the truss bracket the main beam pivots on the locking pin on the adjacent vertical post. When the main beam has reached the next available locating hole it is then pinned into place. The truss bracket is then moved to the next vertical post and the process is repeated until the desired height is reached.

The on-ground automotive lift system may include two longitudinal support structures on either side on the system that are adjustable in length. The length of this system can range from eighty-four inches to approximately one hundred twenty inches depending on the type of vehicle to be lifted. Two main beams may be mounted transversely to the vertical posts. The main beams support the vehicle and rise to a maximum height of about fifty inches above the floor. The system may include adjustable support pads that can be expanded or contracted by a typical range of thirty inches to accommodate vehicles of different widths.

The on-ground automotive lift system is self supporting when erected and does not need to be anchored to the floor or to be set into the ground. Some embodiments may be secured by screw means so they can be disassembled into their parts and stored within the two main beam sections for shipping and storage.

Figure 2:
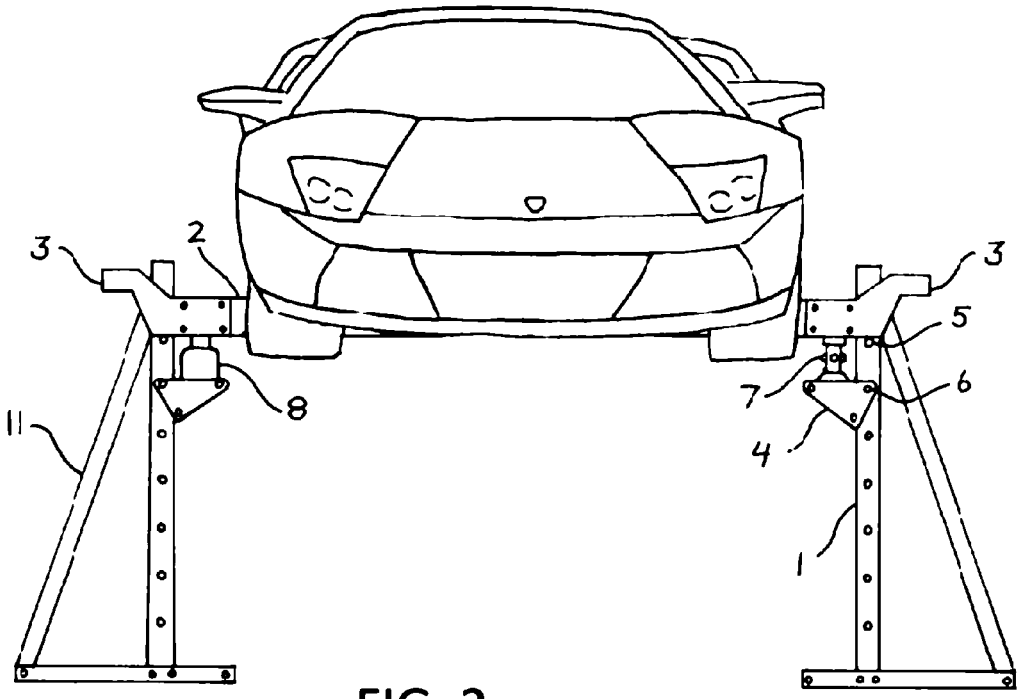
FIG. 2 is the front view of the illustration of FIG. 1.
Figure 3:
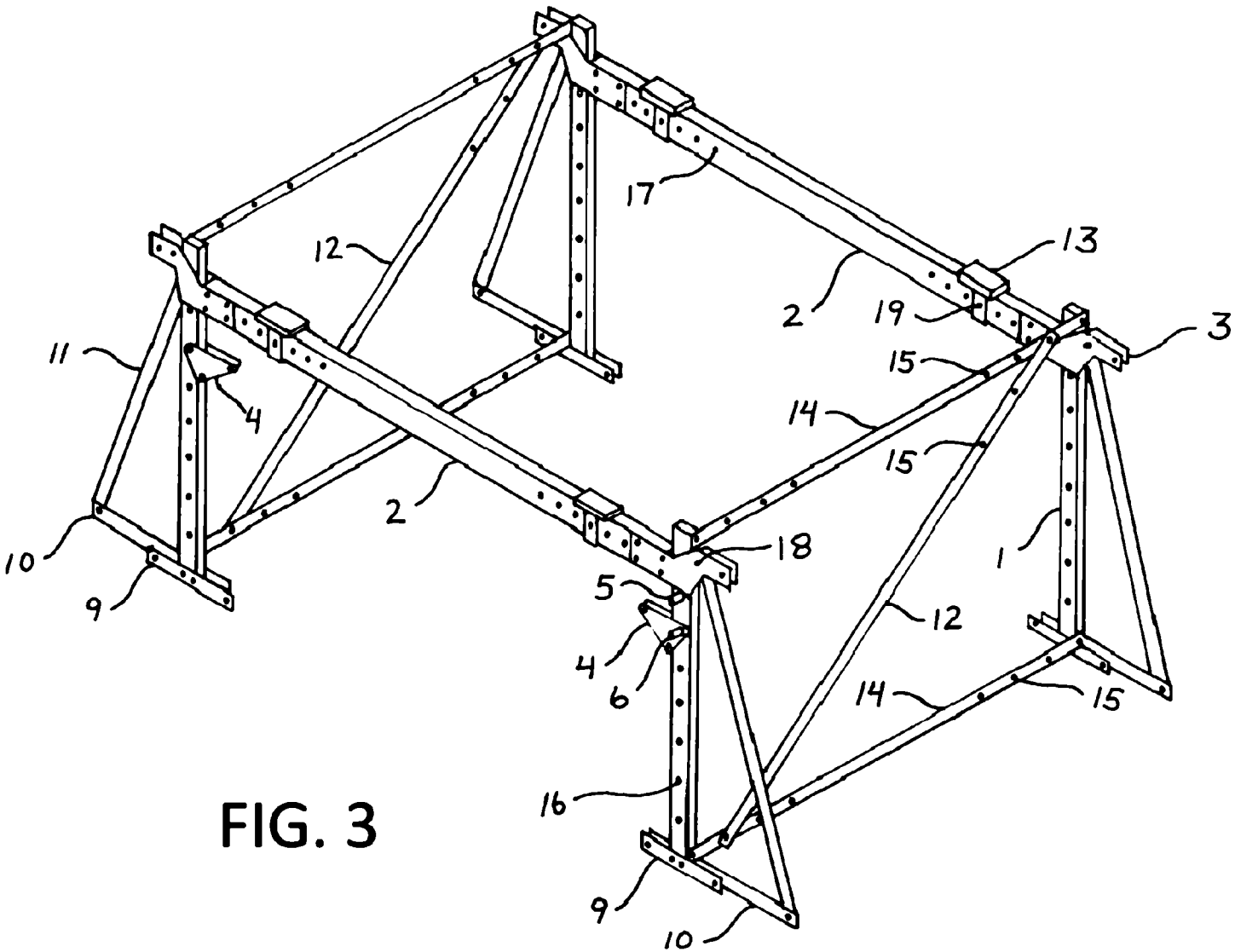
FIG. 3 is a detailed isometric view of the automotive lifting system in the full upright position, without vehicle, showing all major components.

With reference of the views FIGS. 1 thru 3, an embodiment of the inventive automotive lift system is shown comprised of four vertical posts 1. Each of the vertical posts 1 is supported by a short foot 9, and a long foot 10. The vertical post 1 and the long foot 10 are then triangulated with a diagonal support 11 for rigidity. Two of the triangulated vertical posts are positioned on one side of the vehicle and the other two triangulated vertical posts are positioned on the other side of the vehicle. The triangulated vertical posts on each side of the vehicle are connected longitudinally (from front or back) by an upper support 14 and a lower support 15 and then triangulated with a diagonal support 12 for rigidity.

The two main beams 2 are transversely (from left or right) mounted between two of the vertical posts 1 that are positioned on either side of the vehicle as described above. At the end of each of the main beams 2 a bracket 3 is fastened that serves as a guide as the beam is lifted along the vertical post 1. This bracket 3 prevents the main beam 2 from moving longitudinally in the lifting device. In each one of the brackets 3, a pin 18 is fastened that acts as a guide along the vertical post 1 along with the position of the main beam 1 within the bracket 3. This guide prevents the beam from moving transversely in the lifting device. These two guide mechanisms in combination only allow the main beam to be raised and lowered vertically. The main beam 2 is held in place by a pin 5 that is placed in one of a series of holes 16 that are along the vertical post 1.

Figure 4:
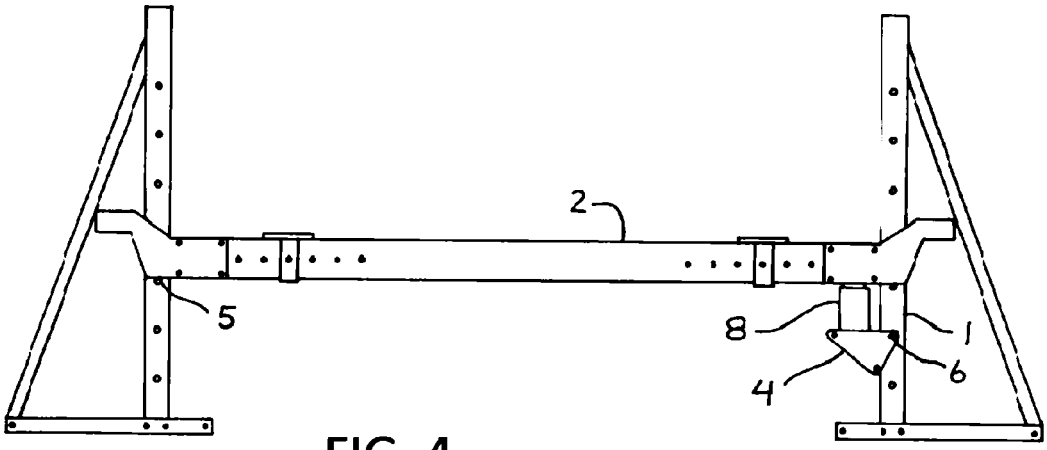
FIG. 4 is a front schematic view of the automotive lifting system, part way elevated, prior to lifting operation.

In the view of FIG. 4 the automotive lifting system is shown part way elevated prior to the lifting operation. Lifting of the device is performed by placing a truss bracket 4 on the vertical post 1, directly beneath locking pin 5 in the next available hole 16 and locking the truss bracket in place with a pin 6. A suitable jack, such as a scissor jack 7, or a hydraulic jack 8, is placed on top of the truss bracket 4 and between the main beam 2.

Figure 5:
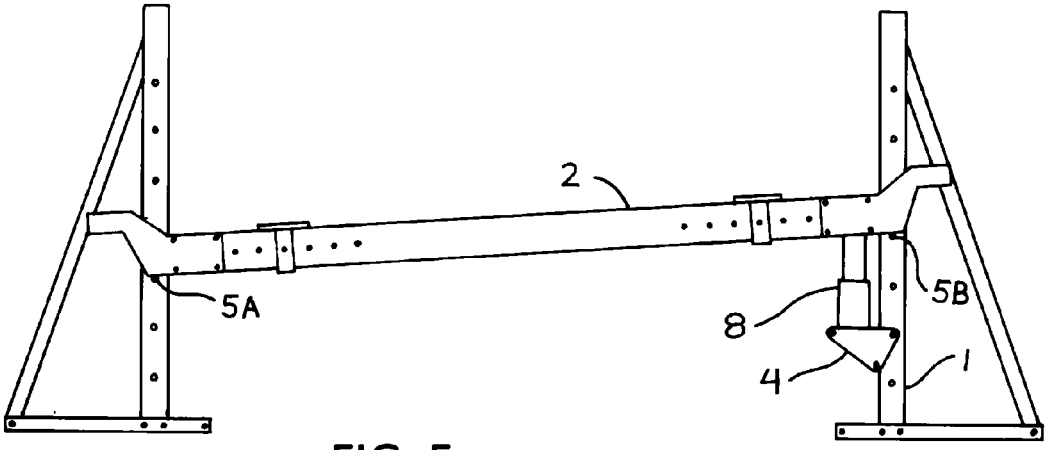
FIG. 5 is a front schematic view of the automotive lifting system, part way elevated, during lifting operation.

In the view of FIG. 5 the automotive lifting system is shown part way elevated during the lifting operation. As the jack 8 is extended, the main beam 2 is pivoted on the locking pin 5A. When the main beam has been lifted to the next locking point a locking pin 5B is inserted into the vertical post to hold the main beam in place.

Figure 6:
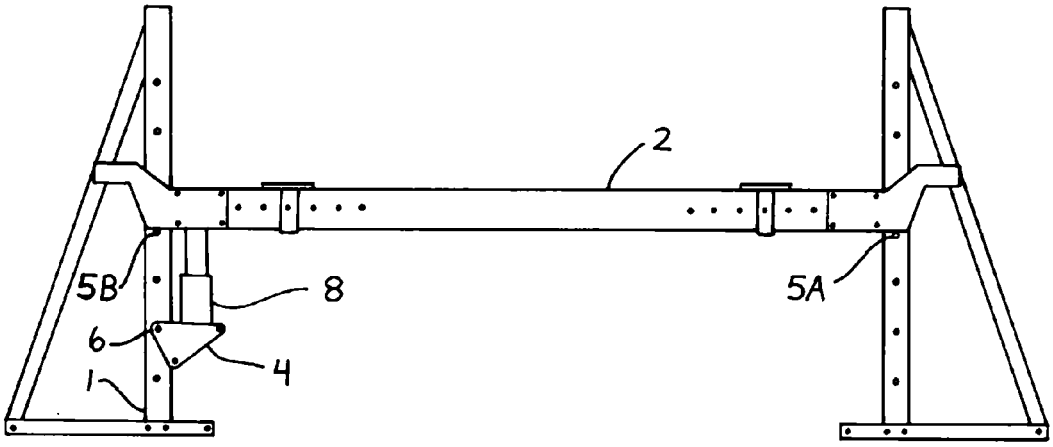
FIG. 6 is a front schematic view of the automotive lifting system, part way elevated, completing lifting operation.
Figure 7:
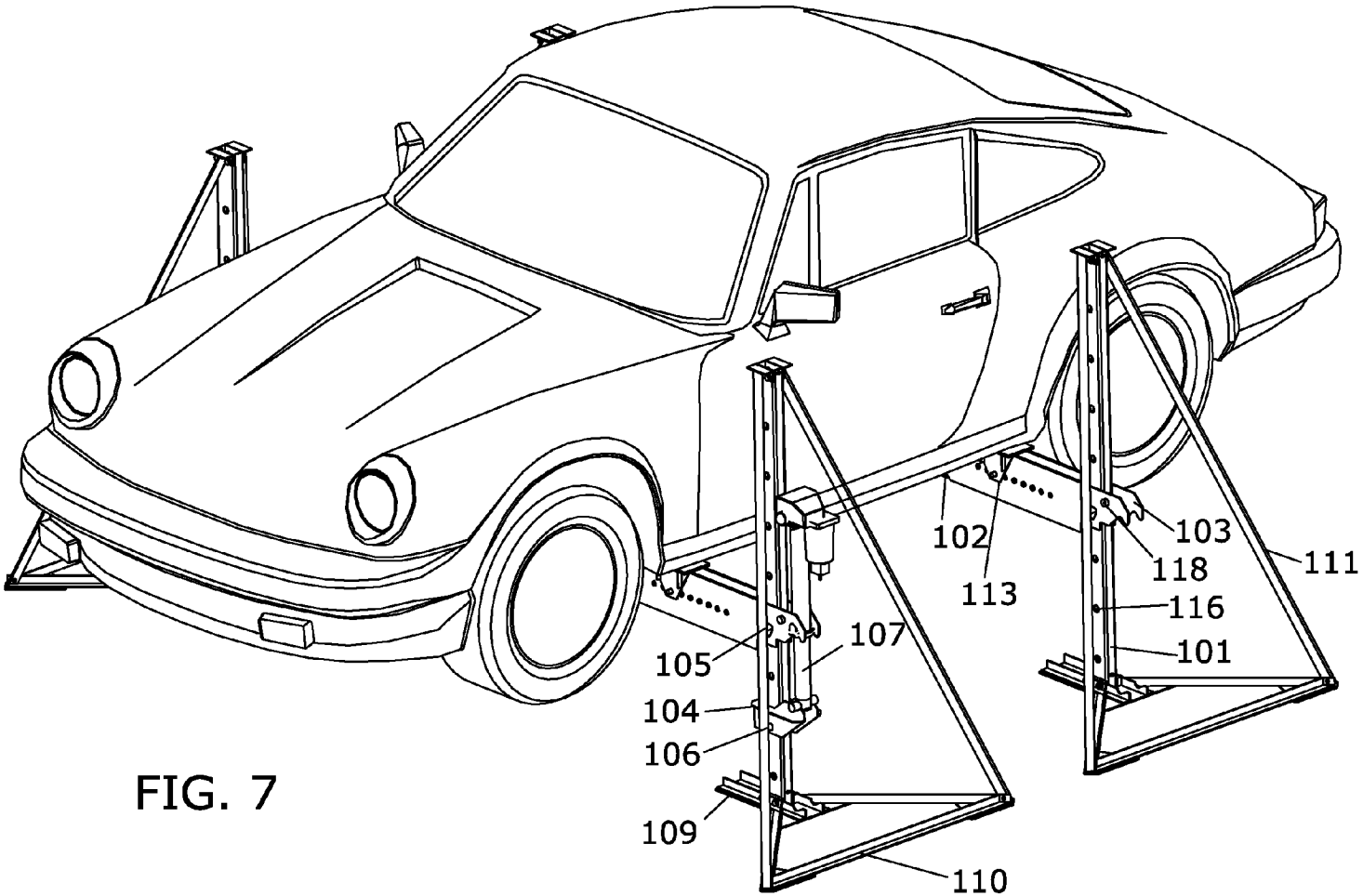
FIG. 7 is an isometric view of a second automotive lifting system in the part way elevated position with vehicle thereupon.
Figure 8:
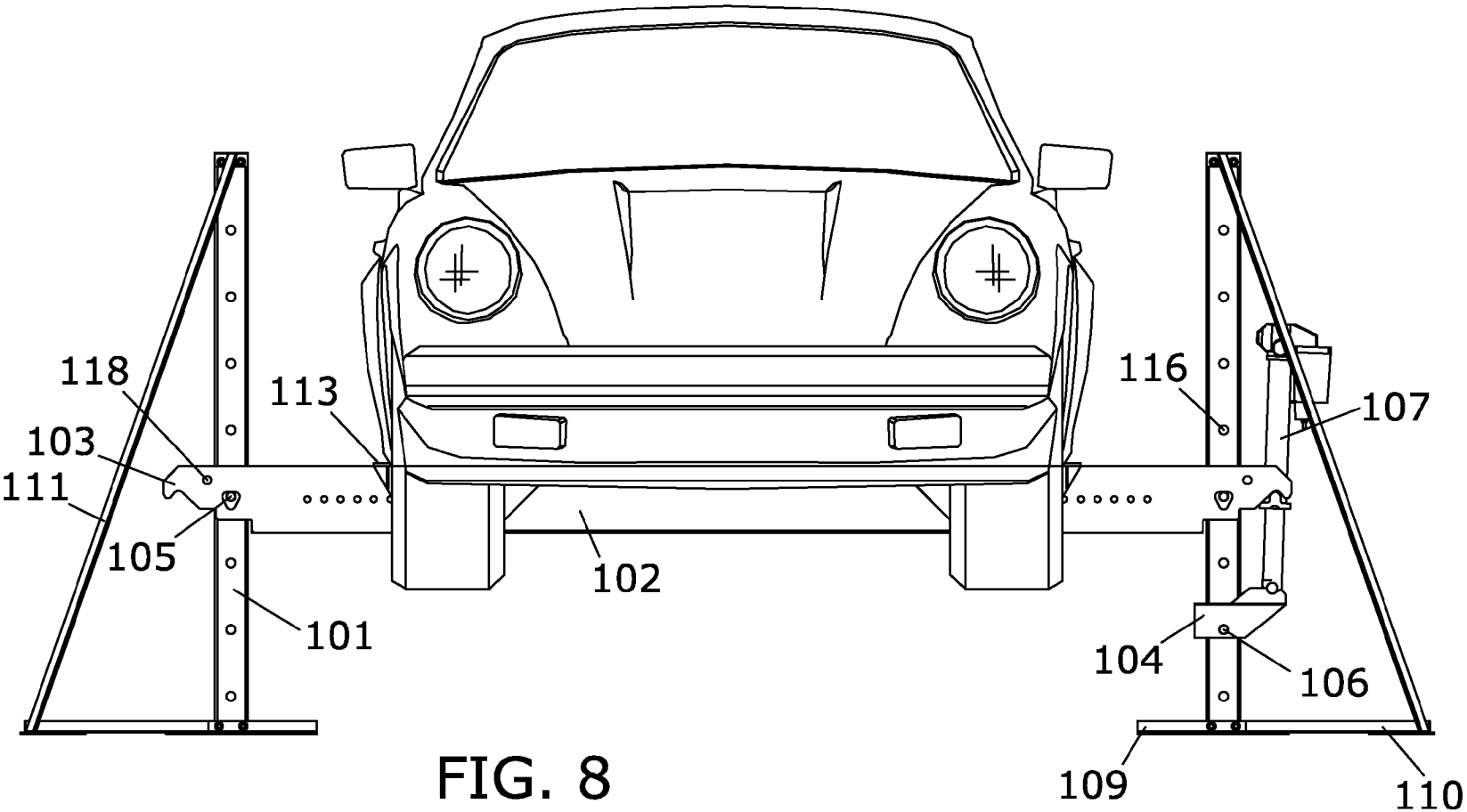
FIG. 8 is the front view of the illustration of FIG. 7.

In the view of FIG. 6 the automotive lifting system is shown part way elevated completing the lifting operation. The truss bracket 4 and jack 8 are moved to the vertical post 1, on the other end of the main beam 1 and placed directly beneath locking pin 5 that is supporting the main beam. The truss bracket is held in place with in the next available hole 16 with pin 6. As the jack 8 is extended, the main beam 2 is pivoted on the locking pin 5A. When the main beam has been lifted to the next locking point a locking pin 5B is inserted into the vertical post to hold the main beam in place. The process described above and illustrated in FIG. 4 thru 6 is repeated from one vertical post to the next until the desired height is reached. To lower the vehicle the process described above and illustrated in FIG. 4 thru 6 is reversed.

With reference to FIG. 3, when the lifting device is in the full downward position the brackets 3 that are fastened to the main beam 1 serve as lifting points on the outside of the vertical post 1. This is needed because there is no clearance under the main beam 1 when the lifting device is in its lowest position.

With reference to FIG. 3, the automotive lifting device is adjustable transversely to accommodate vehicles of different widths. The main support beam 1 has additional mounting points 17, by securing the support pads 13 by a pin 19 to different mounting points 17 in the main beam 1 the lifting device can be expanded or contracted by a typical range of thirty inches.

With further reference to views in FIG. 3 the automotive lifting device is adjustable longitudinally to accommodate vehicles of different lengths. The upper and lower supports 14 and the diagonal support 12 have additional mounting points 15. By securing the vertical posts 1 by different mounting points in the upper and lower supports 14 and the diagonal support 12 the lifting device can be expanded or contracted by a typical range of thirty six inches.

In operation a typical height of the lifting device above the floor will be fifty inches. The longitudinal dimensions will very depending upon the type of vehicle to be lifted. The typical range is of such length is between eighty four inches and one hundred twenty inches.

With reference of the views FIGS. 7 thru 17, a second embodiment of the inventive automotive lift system is shown comprised of four vertical posts 101. Each of the vertical posts 101 are supported by an inside foot 109 and a base 110. The vertical post 101 and the base 110 are then triangulated with a diagonal support 111 for rigidity. Two of the triangulated vertical posts 101 are positioned on one side of the vehicle and the other two triangulated vertical posts are positioned on the other side of the vehicle. The triangulated vertical posts 101 may be sufficiently stable that further supports connecting adjacent vertical posts are not required.

The two main beams 102 are transversely (from left or right) mounted between two of the vertical posts 101 that are positioned on either side of the vehicle as described above. At each end of each of the main beams 102 a bracket 103 is fastened that serves as a guide as the beam is lifted along the vertical post 101. This bracket 103 prevents the main beam 102 from moving longitudinally in the lifting device. In each one of the brackets 103, a pin 118, is fastened that acts as a guide along the vertical post 101 along with the position of the main beam 101 within the bracket 103. This guide prevents the beam from moving transversely in the lifting device. These two guide mechanisms in combination allow the main beam to only be raised and lowered vertically. The main beam 102 is held in place by a pin 105 that is placed in one of a series of holes 116 that are along the vertical post 101.

Figure 10:
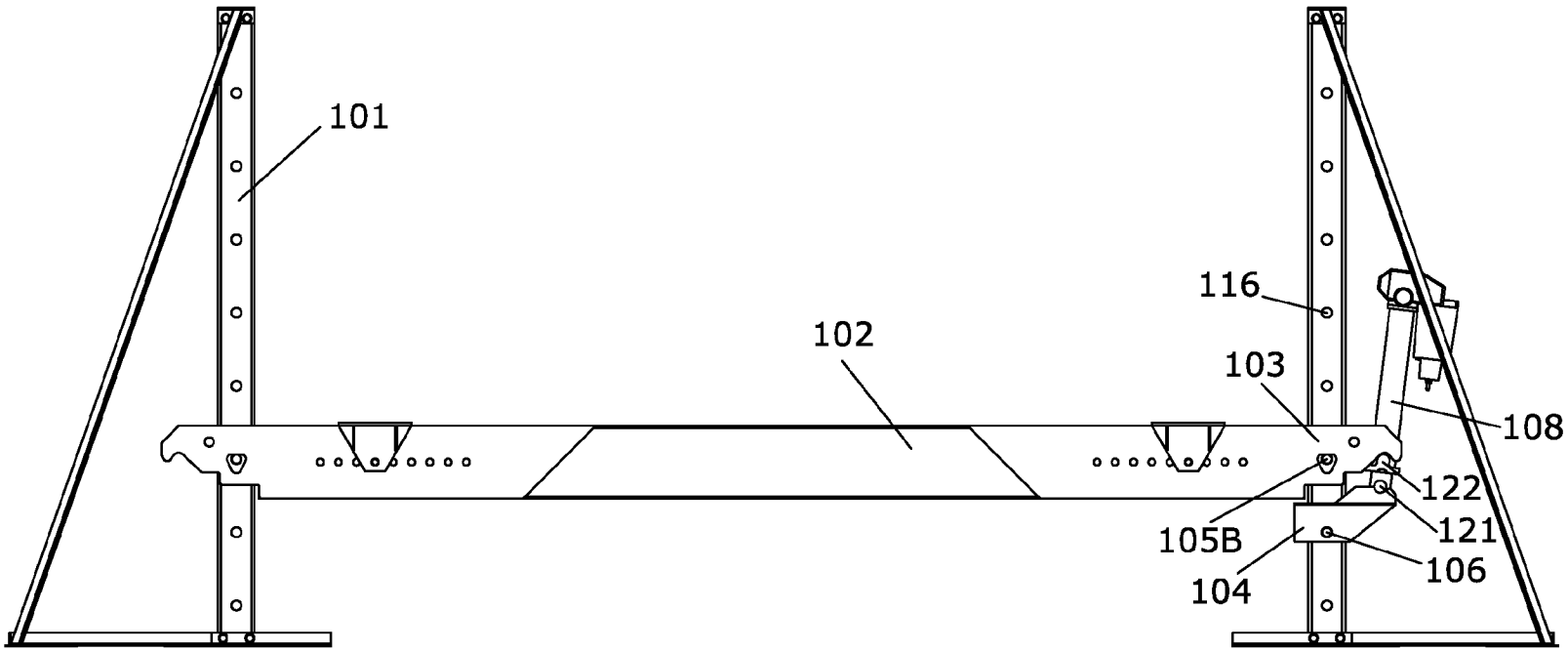
FIG. 10 is a front schematic view of the second automotive lifting system, part way elevated, prior to lifting operation.
Figure 13B:
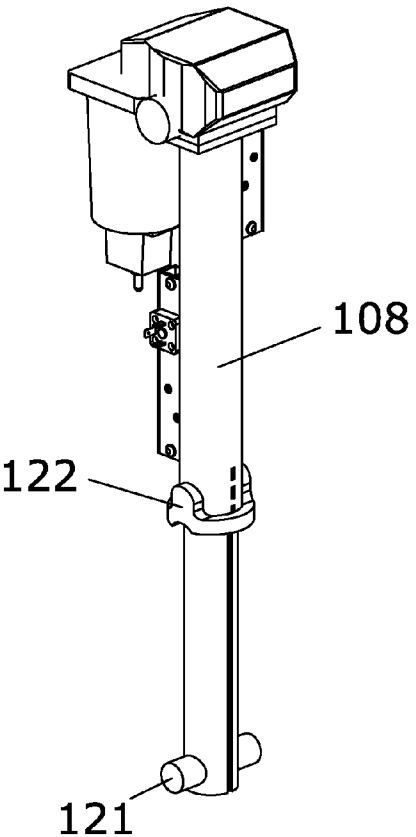
FIGS. 13A and 13B are isometric views showing the front and back of the electrically powered lead screw type jack in the fully extended position.
Figure 13A:
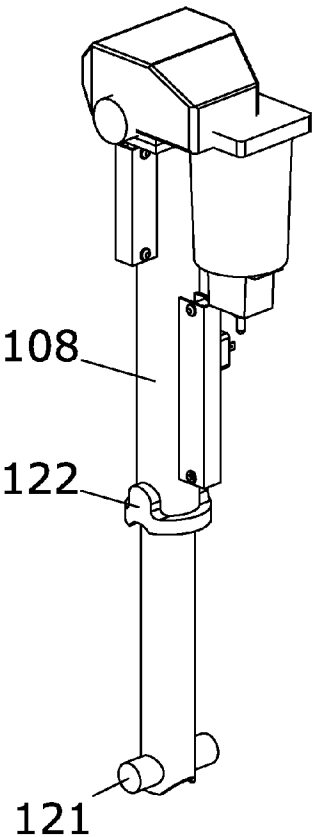

In the view of FIG. 10 the automotive lifting system is shown part way elevated prior to the lifting operation. Lifting of the device is performed by placing a truss bracket 104 on the vertical post 101, directly beneath locking pin 105 in the next available hole 116 and locking the truss bracket in place with a pin 106. A suitable jack, such as a scissor jack, a hydraulic jack, or an electric lead screw type jack 108 as illustrated in FIGS. 13A and 13B is placed on top of the truss bracket 104 and engaging the bracket 103 at one end of the main beam 102 for lifting.

Figure 11:
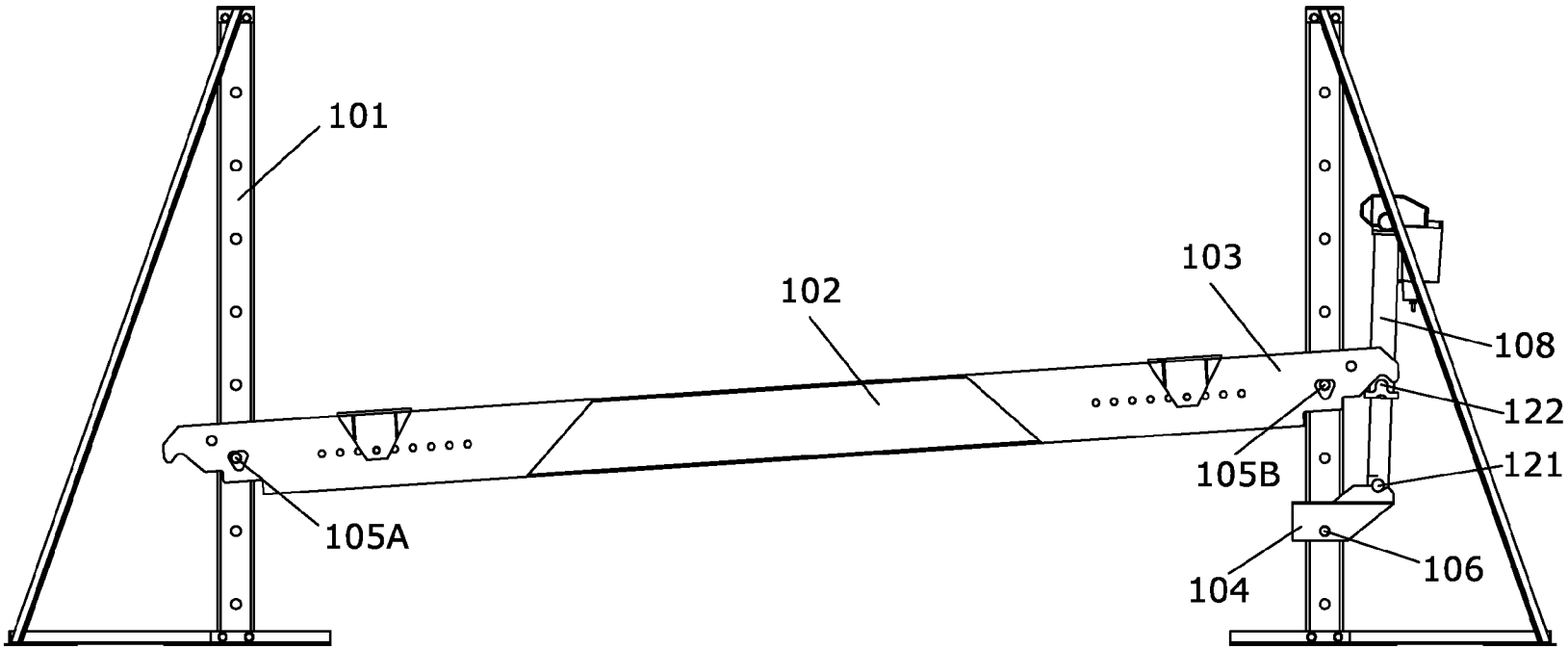
FIG. 11 is a front schematic view of the second automotive lifting system, part way elevated, during lifting operation.

In the view of FIG. 11 the automotive lifting system is shown part way elevated during the lifting operation. As the jack 108 is extended, the main beam 102 is pivoted on the locking pin 105A. When the main beam has been lifted to the next locking point a locking pin 105B is inserted into the vertical post to hold the main beam in place.

Figure 14:
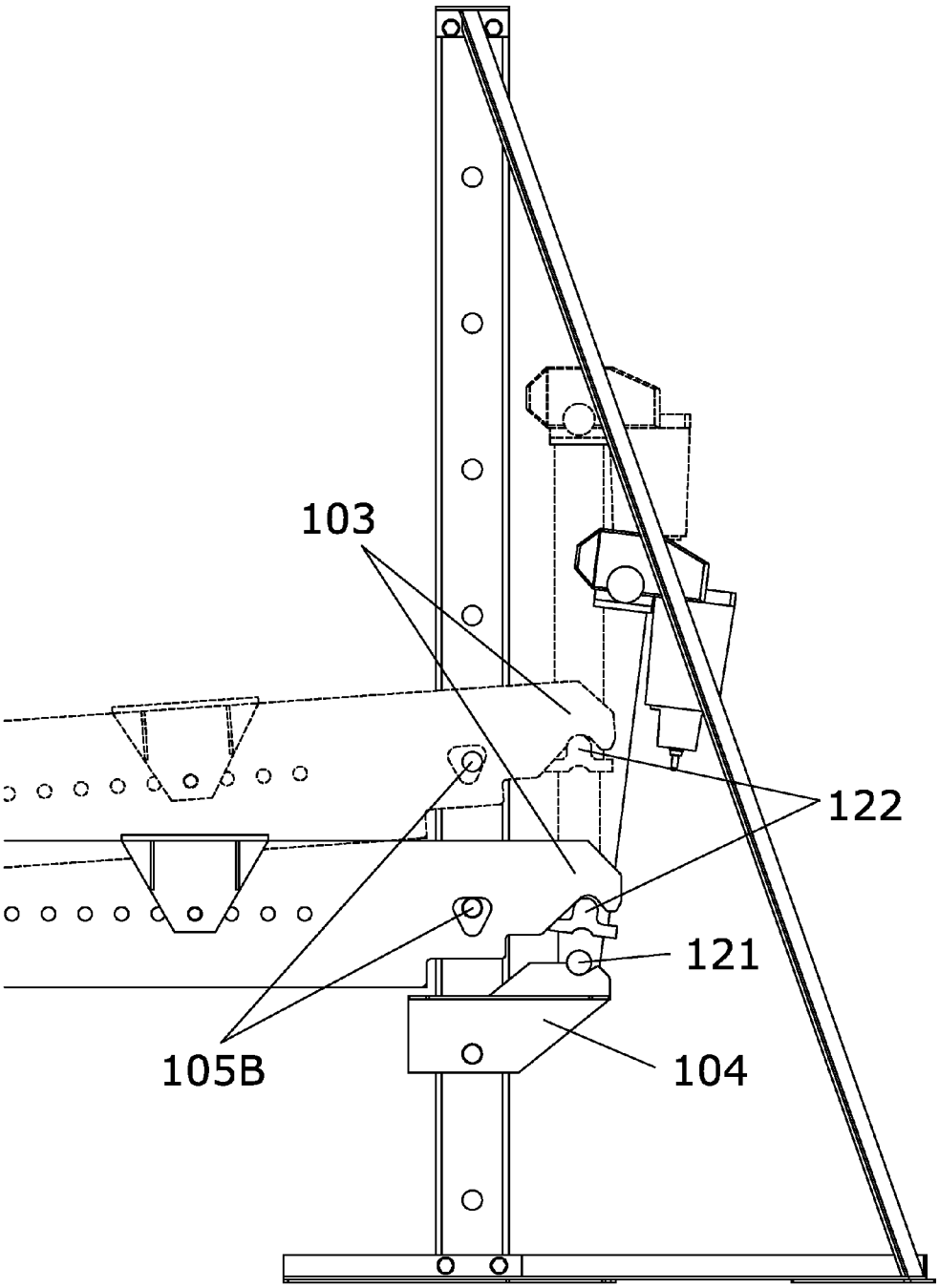
FIG. 14 is the front view of the automotive lifting system, illustration the lifting action, and showing the electrically powered lead screw type jack in the fully extended and fully retracted positions.
Figure 15:
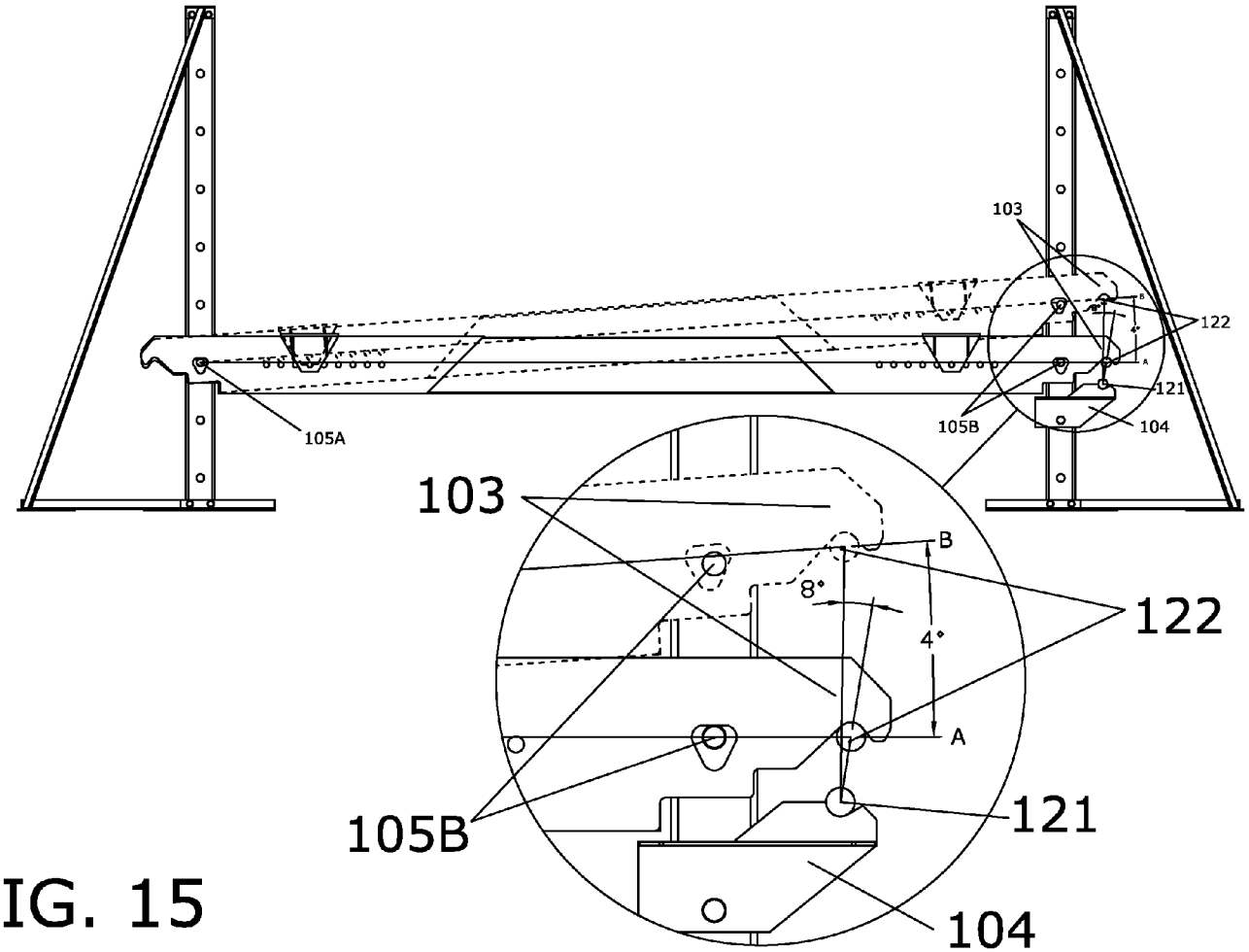
FIG. 15 is the front view of the automotive lifting system, detailing the motion of the device during the lifting action.

FIGS. 14 and 15 show the bracket 103 in a solid line view that corresponds to the position illustrated in FIG. 10 and a broken line view that corresponds to the position illustrated in FIG. 11. It will be noted that the bracket 103 provides a hole for the locking pin 105 that is sized and shaped to accommodate the increased distance between the locking pins 105A, 105B when one end of the main beam 102 is raised. As illustrated, the jack 108 may be supported by the truss bracket 104 with a pin 121 on the jack 108 that rests in a notch on the truss bracket. The jack 108 may be coupled to the main beam 102 by a lifting point 122 that engages a notch on the brackets 103 coupled to the ends of the main beam.

Figure 12:
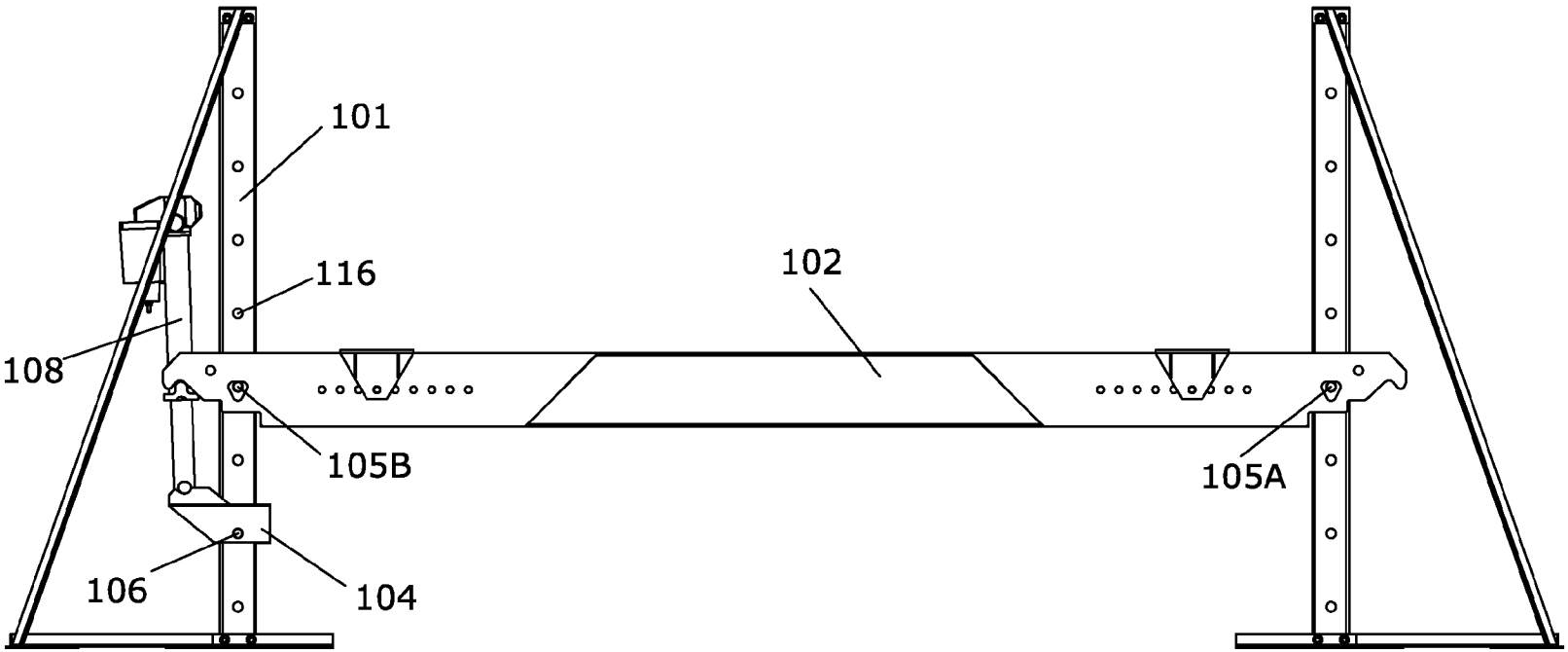
FIG. 12 is a front schematic view of the second automotive lifting system, part way elevated, completing lifting operation.

In the view of FIG. 12 the automotive lifting system is shown elevated to a higher level, completing the lifting operation. The truss bracket 104 and jack 108 are moved to the vertical post 101 on the other end of the main beam 102 and placed directly beneath locking pin 105 that is supporting the main beam. The truss bracket is held in place with a pin 106 in the next available hole. As the jack 108 is extended, the main beam 102 is pivoted on the locking pin 105A. When the main beam has been lifted to the next locking point a locking pin 105B is inserted into the vertical post to hold the main beam in place. The process described above and illustrated in FIG. 10 thru 12 is repeated from one vertical post to the next until the desired height is reached. To lower the vehicle the process described above and illustrated in FIG. 10 thru 12 is reversed.

Figure 9:
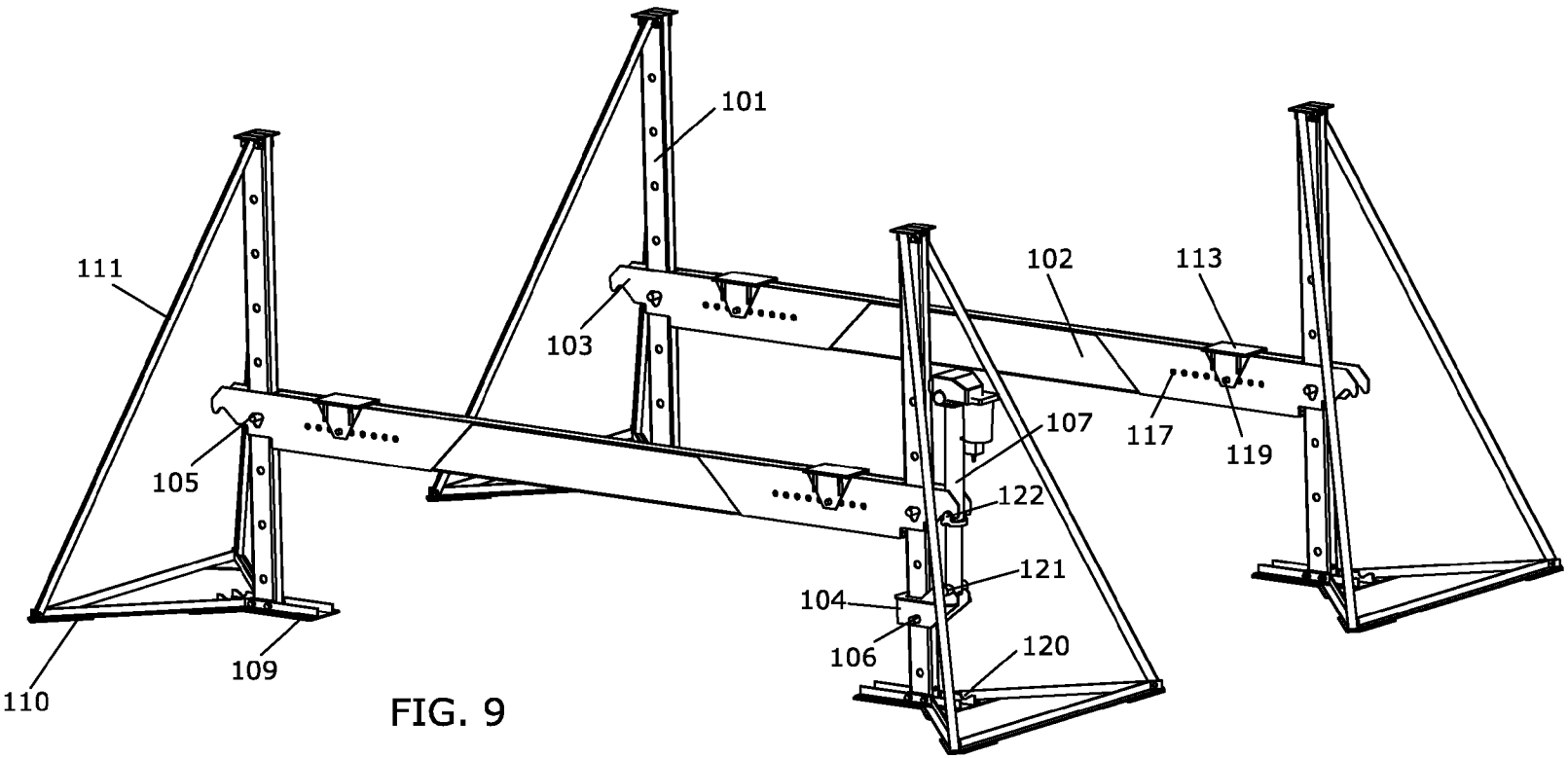
FIG. 9 is a detailed isometric view of the second automotive lifting system in the part way elevated position, without vehicle, showing all major components.

With reference to FIG. 9, when the lifting device is in the full downward position the brackets 103 that are fastened to the main beam 102 serve as lifting points on the outside of the vertical post 101. This is needed because there is no clearance under the main beam 101 when the lifting device is in its lowest position.

With reference to FIG. 9, the automotive lifting device is adjustable transversely to accommodate vehicles of different widths. Each assembly of a pair of vertical posts 101, supported main beam 102, and associated parts forms an independent lift assembly. The automotive lifting device includes at least two such lift assemblies which can be placed on a supporting floor with a wide range of spacing between the main beams to accommodate vehicles of different lengths. The typical longitudinal range is of such length is between eighty four inches and one hundred twenty inches. In operation a typical height of the lifting device above the floor will be fifty inches.

A distinctive feature of the invention not apparent from the illustrations is that the components are secured typically by screw means and that the entire assembly can be disassembled into its parts and stored. This feature in combination with the assembly not requiring anchoring to the floor makes the unit easily storable and portable.

Accordingly, while there has been shown and described the preferred layout of the present invention it is to be stated that the invention may be constructed otherwise then in herein specifically shown and described and that, within the layout, certain changes may be made within the arrangement and form of the components without departing from the underlying idea or principles of this invention as set forth in the clams appended herewith. Such changes to the arrangement and components are described below.

The vertical posts 1 (FIG. 3), 101 (FIG. 7) are illustrated as rectangular posts with holes to accept pins. These rectangular posts could be manufactured from many other shapes of materials such as square, round, channel, I-beam, angle, plate, stampings, or castings and could incorporate other features such as part of the foot, side supports, or diagonal support.

The vertical posts are shown with holes 16, 116 to accept pins. These pins locate and lock the main beam 2, 102 and truss bracket 4, 104. This locating and locking mechanism can be constructed in a variety of different ways such as, ratchets, cams, racks, hooks, snaps, toggle or other locating locking devices.

The vertical posts 1, 101 could also incorporate a lifting device such as a bumper type jack, scissor type jack, lead screw type jack, or other type jack to raise and lower the main beams. The lifting device could also be constructed in many other ways by using cylinders, either pneumatic or hydraulic, screws, levers, racks, ratchets, toggles, linkages or any combination thereof, either manually operated or powered operated.

The feet 9, 10 and the diagonal support 11 in FIG. 3 are illustrated as rectangular bars but could be manufactured from many other shapes of materials such as square, round, channel, I-beam, angle, plate, stampings, or castings and incorporate other features such as part of the vertical post, or parts of the support assembly. These assemblies could also be supported in such a way that they no longer form a triangle but form another shape such as arch, truss, buttress, rib, bulkhead, or other supporting shapes. The supporting shape or structure could also appear on one or many different sides of the structure and not just outside of the assembly as illustrated.

The triangulated vertical posts on each side of the vehicle are shown as free standing in FIG. 9 but could be connected longitudinally by an upper and lower support 14 and then triangulated with a diagonal support 12 as shown in FIG. 3. These components are illustrated as rectangular bars but could be manufactured from many other shapes of materials such as, square, round, channel, I-beam, angle, plate, stampings, or castings and could incorporate other features such as part of the foot, diagonal supports, or vertical posts. They could also be constructed is such a way that they no longer form longitudinal supports with diagonal bracing but form some other shape such as arch, truss, buttress, rib, bulkhead, or other supporting shape or structure. The supporting shape or structure could also appear on one or many different sides of the structure and not just between the two vertical posts.

The two main beams 2, 102 are transversely mounted between the two vertical posts 1, 101. These components are illustrated as rectangular beams but could be manufactured from many other shapes of materials such as, square, round, channel, I-beam, angle, plate, stampings, or castings and could incorporate other features such as part or all of the bracket, and or the support pads. The main beams could also be made from several pieces and fastened together in various ways such as screws or weld. The vehicle could also be lifted by more than two main beams. For instance, four cantilevered supports could be suspended from the vertical posts and used to lift the vehicle. The main beams could also incorporate lifting devices to raise and lower the vehicle. This could be done in many ways such as with cylinders, either pneumatic or hydraulic, or with screws, levers, racks, ratchets, toggles, linkages or any combination thereof, either manually operated or powered operated.

The truss brackets 4, 104 are illustrated as triangular plates but could be manufactured from many other shapes of plates or constructed from other shapes of materials such as, square, round, channel, I-beam, or angle, and fasten together in a variety of ways such as with screw or weld. The truss brackets could also be made from plates, stampings, or castings and incorporate other features such as the locating and locking devices or lifting devices to raise and lower the main beam and or lifting devices to raise or lower the truss bracket. This could be done in many ways such as cylinders, either pneumatic or hydraulic, screws, levers, ratchets, toggles, linkages or any combination there of, either manually operated or powered operated.

The locating and locking devices 5, 6, 105, 106 are illustrated as a pin inserted into a hole. These could be manufactured in many ways such as a hook, ratchet, cams, racks, snaps, or toggles and could be incorporated into the truss brackets or brackets on the main beams.

What is claimed is:

1. An on-ground automotive lift system comprising:

four vertical posts;

two main beams, each main beam having two opposing ends, each end of the main beams being movably coupled to one vertical post;

a truss bracket removably located and locked to one of the vertical posts at one of a plurality of heights; and a lifting device directly supported at a lower end of the lifting device by the truss bracket and coupled at an upper end of the lifting device to one end of one of the main beams in a lifting position.

2. The on-ground automotive lift system of claim 1 further comprising:

four short feet, each short foot coupled to a lower end of one of the vertical posts;

four long feet, each long foot coupled to a lower end of one of the vertical posts; and four diagonal supports, each diagonal support having a first end coupled to one of the long feet and an opposing second end coupled to an upper end of one of the vertical posts to provide a triangulated support for the vertical post.

3. The on-ground automotive lift system of claim 2 further comprising:

two lower supports, each lower support coupled to a lower end of one of the vertical posts, each of the two coupled vertical posts supporting different main beams;

two upper supports, each upper support coupled to an upper end of one of the vertical posts, each of the two coupled vertical posts supporting different main beams; and two diagonal supports, each diagonal supports coupled to one of the lower supports and one of the upper supports to provide triangulated support for two of the coupled vertical posts.

4. The on-ground automotive lift system of claim 1 further comprising:

four bases, each base coupled to a lower end of one of the vertical posts; and at least four diagonal supports, each diagonal support having a first end coupled to one of the bases and an opposing second end coupled to an upper end of one of the vertical posts to provide a triangulated support for the vertical post.

5. The on-ground automotive lift system of claim 4 further comprising four inside feet, each foot coupled to the lower end of one of the vertical posts.

6. The on-ground automotive lift system of claim 1 further comprising:

four brackets, each bracket coupled to one of the ends of the main beams to movably couple the end of the main beam to one of the vertical posts; and four pins, each pin inserted into one of a plurality of holes in one of the vertical posts to support one of the brackets.

7. The on-ground automotive lift system of claim 6 further comprising a fifth pin inserted into one of a plurality of holes in one of the vertical posts to locate and lock the truss bracket to the one of the vertical posts.

8. The on-ground automotive lift system of claim 1 wherein the lifting device is an electric lead screw type jack.

9. An on-ground automotive lift assembly comprising:

two vertical posts;

a main beam having two opposing ends, each end being movably coupled to one vertical post;

a truss bracket removably located and locked to one of the vertical posts at one of a plurality of heights; and a lifting device directly supported at a lower end of the lifting device by the truss bracket and coupled at an upper end of the lifting device to one end of one of the main beams in a lifting position.

10. The on-ground automotive lift system of claim 9 further comprising:

two short feet, each short foot coupled to a lower end of one of the vertical posts;

two long feet, each long foot coupled to a lower end of one of the vertical posts; and two diagonal supports, each diagonal support having a first end coupled to one of the long feet and an opposing second end coupled to an upper end of one of the vertical posts to provide a triangulated support for the vertical post.

11. The on-ground automotive lift system of claim 9 further comprising:

two bases, each base coupled to a lower end of one of the vertical posts; and at least two diagonal supports, each diagonal support having a first end coupled to one of the bases and an opposing second end coupled to an upper end of one of the vertical posts to provide a triangulated support for the vertical post.

12. The on-ground automotive lift system of claim 9 further comprising:

two bases, each base coupled to a lower end of one of the vertical posts; and four diagonal supports, each diagonal support having a first end coupled to one of the bases and an opposing second end coupled to an upper end of one of the vertical posts, the first ends being spaced apart on the base to provide a triangulated support for the vertical post.

13. The on-ground automotive lift system of claim 9 further comprising two inside feet, each foot coupled to a lower end of one of the vertical posts.

14. The on-ground automotive lift system of claim 9 further comprising:

two brackets coupled to the opposing ends of the main beam, each bracket to movably couple the end of the main beam to one of the vertical posts; and two pins, each pin inserted into one of a plurality of holes in one of the vertical posts to support one of the brackets.

15. The on-ground automotive lift system of claim 14 further comprising a third pin inserted into one of a plurality of holes in one of the vertical posts to locate and lock the truss bracket to the one of the vertical posts.

* * * * *